US006491033B1

(12) United States Patent
Motose et al.

(10) Patent No.: US 6,491,033 B1
(45) Date of Patent: Dec. 10, 2002

(54) OXYGEN SENSOR AND FEEDBACK SYSTEM FOR OUTBOARD MOTOR ENGINE

(75) Inventors: Hitoshi Motose, Shizuoka (JP); Kyoji Hakamata, Shizuoka (JP); Kimihiro Nonaka, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/583,347

(22) Filed: May 31, 2000

(30) Foreign Application Priority Data

May 31, 1999 (JP) ..... 11-151478

(51) Int. Cl.[7] ..... F02D 41/14
(52) U.S. Cl. ..... 123/683; 123/687; 123/694
(58) Field of Search ..... 123/683, 684, 123/687, 693, 694; 701/109

(56) References Cited

U.S. PATENT DOCUMENTS 4,546,747 A * 10/1985 Kobayashi et al. ..... 123/674
4,715,350 A * 12/1987 Kawanabe et al. ..... 123/684
4,759,329 A * 7/1988 Nobuo et al. ..... 123/689 X
4,982,714 A * 1/1991 Takahashi et al. ..... 123/684
5,697,353 A * 12/1997 Katoh et al. ..... 123/679
5,832,724 A * 11/1998 Watanabe et al. ..... 123/685 X
5,918,275 A 6/1999 Kato et al. ..... 73/116
5,983,878 A 11/1999 Nonaka et al. ..... 123/687
6,024,069 A * 2/2000 Yoshino ..... 701/103 X
6,058,907 A 5/2000 Motose et al. ..... 123/305
6,067,957 A * 5/2000 Motose et al. ..... 123/305

* cited by examiner

*Primary Examiner*—Tony M. Argenbright
(74) *Attorney, Agent, or Firm*—Knobbe, Martens, Olson & Bear, LLP.

(57) ABSTRACT

An outboard motor engine includes a feedback control system for controlling the air/fuel ratio of the air/fuel mixture combusted within the engine. The control system can be configured to vary the target output value of a combustion condition sensor in accordance with at least one engine operation characteristic, for example, but without limitation, engine speed or throttle position.

9 Claims, 4 Drawing Sheets

Engine Speed (N)

| Throttle Position Sensor Output ($T_V$) | 500 | 600 | 800 | 1000 | 1500 | 2000 | 2500 | 3000 | 3500 | 4000 | 4500 | 5000 | 5500 | 6000 | 6500 | 7000 |
|---|---|---|---|---|---|---|---|---|---|---|---|---|---|---|---|---|
| 0.5 | a | a | a | a | a | a | a | a | a | b | b | b | b | b | b | b |
| 0.6 | a | a | a | a | a | a | a | a | a | b | b | b | b | b | b | b |
| 0.7 | a | a | a | a | a | a | a | a | a | b | b | b | b | b | b | b |
| 0.8 | a | a | a | a | a | a | a | a | a | b | b | b | b | b | b | b |
| 0.9 | a | a | a | a | a | a | a | a | a | b | b | b | b | b | b | b |
| 1 | a | a | a | a | a | a | a | a | a | b | b | b | b | b | b | b |
| 1.2 | a | a | a | a | a | a | a | a | a | b | b | b | b | b | b | b |
| 1.4 | c | c | c | c | c | c | c | c | c | b | b | b | b | b | b | b |
| 1.6 | c | c | c | c | c | c | c | c | c | b | b | b | b | b | b | b |
| 2 | c | c | c | c | c | c | c | c | c | b | b | b | b | b | b | b |
| 2.5 | c | c | c | c | c | c | c | c | c | b | b | b | b | b | b | b |
| 3 | c | c | c | c | c | c | c | c | c | b | b | b | b | b | b | b |
| 4 | c | c | c | c | c | c | c | c | c | b | b | b | b | b | b | b |

*Figure 3*

OXYGEN SENSOR AND FEEDBACK SYSTEM FOR OUTBOARD MOTOR ENGINE

PRIORITY INFORMATION

This application is based on and claims priority to Japanese Patent Application No. 11-151478 filed May 31, 1999, the entire contents of which is hereby expressly incorporated by reference.

BACKGROUND OF THE INVENTION

1. Field of the Invention

The present invention relates to a feedback control system for an engine. More specifically, the present invention relates to an improved feedback control system for an engine of an outboard motor.

2. Description of Related Art

In all fields of engine design, there is an increasing emphasis on obtaining more effective emission control, better fuel economy and, at the same time, continued high or higher power output. In pursuit of better fuel economy and emission control, various types of control systems have been developed in conjunction with internal combustion engines. One of the more effective types of controls is so-called "feedback" control. With this type of control, a basic air/fuel ratio is set for the engine. Adjustments are then made from the basic setting based upon the output of the sensor that senses the air/fuel ratio in the combustion chamber in order to bring the air/fuel ratio into the desired range.

Normally, the type of sensor employed for such feedback control is an oxygen ($O_2$) sensor which outputs an electrical signal. Generally, when the output signal voltage is high, little oxygen is present in the exhaust, indicating that a combusted air/fuel charge was rich in fuel. On the other hand, when the output signal voltage is low, substantial amounts of oxygen are present in the exhaust, thus indicating that a combusted charge was rich in air.

A conventional oxygen sensor is normally associated with a wave forming circuit which manipulates the output of the sensor to indicate an "on" signal when the voltage of the output signal exceeds a reference voltage (i.e., a signal which results when the supplied charge is rich in fuel). On the other hand, the circuit manipulates the signal to indicate that the sensor is "off" when the voltage of the output signal does not exceed the reference voltage (i.e., a signal which results from a supplied charge that is rich in air).

The control operates on a feedback control principle, continuously making corrections to accommodate deviations from the desired air/fuel ratio. Adjustments are made in stepped intervals until the sensor output goes to the opposite sense from its previous signal. For example, if the mixture is too rich in fuel (i.e., the sensor is "on," then lean adjustments are made until the mixture strength is sensed to be lean (i.e., the sensor signal turns "off"). Adjustments are then made back into the rich direction in order to approximately maintain the desired ratio.

Most commonly, the oxygen sensor is the type which utilizes inner and outer platinum or platinum-coated electrodes. However, the platinum acts as a catalyst, which catalyzes the exhaust. For example, oxygen remaining in the exhaust may be catalyzed with carbon monoxide at the platinum electrode interface, creating carbon dioxide. While the effects of the platinum in improving the exhaust gas emissions may be advantageous, the oxygen content of the gas being sensed can be affected to a degree which causes the sensor to provide inaccurate data, causing the associated control system to adjust the air/fuel ratio erroneously.

For example, while the actual oxygen content of the exhaust system may correspond to an air rich air/fuel charge such that the actual signal from the sensor should indicate that the sensor is "off," the above-described effect may cause the sensor to indicate little oxygen is present (i.e., as if a rich fuel charge has been supplied) by an "on" signal. In that instance, the feedback control is arranged to adjust the air/fuel ratio in the fuel rich direction in response to the "on" signal even though the mixture is already fuel rich.

SUMMARY OF THE INVENTION

One aspect of the present invention includes the realization that some known feedback control systems have been found to inaccurately control air/fuel ratio in an internal combustion engine. In particular, it has been found that known feedback control systems do not accurately generate the desired air/fuel ratio for combustion in the combustion chambers of the associated engine. For example, it has been found that in direct-injected 2-cycle engines, the perceived oxygen concentration in the exhaust gases, and thus the voltage output of the oxygen sensor, varies according to throttle angle and engine speed when subjected to exhaust gases having the same oxygen content. Thus, it is desirable to provide a feedback control system which can compensate for errors generated by the varying output of the oxygen sensor in different operation states of the engine.

Accordingly, an outboard motor constructed in accordance with another aspect of the present invention includes an internal combustion engine having an engine body defining at least one combustion chamber. A charge former is connected to the engine and is configured to deliver fuel to the engine body to form an air/fuel mixture within the combustion chamber. A combustion condition sensor communicates with a combustion chamber and is configured to output a signal indicative of a combustion condition in the combustion chamber. A controller is configured to control operation of the charge former. The controller includes a memory having a 3-dimensional map stored therein, the 3-dimensional map includes data regarding a target output value of the combustion condition sensor as a function of a first and a second engine operation condition. The controller is configured to adjust an air/fuel ratio of the fuel and air delivered to the engine such that a value of the output signal of the combustion condition sensor is approximately the target output value.

By including a 3-dimensional map in the controller, the present invention overcomes the problems discovered in connection with the performance of combustion condition sensors. In particular, the present invention overcomes the problems stemming from the variation of the performance of an oxygen sensor with respect to different operating states of the engine. By including a 3-dimensional map which includes data regarding target output voltages of the sensor, the controller can compensate for variations in the performance of the sensor under varying engine operating states.

According to another aspect of the invention, an outboard motor includes an internal combustion engine having an engine body defining at least one combustion chamber, a charge former configured to deliver fuel to the engine body to form an air/fuel mixture within the combustion chamber, and a combustion condition sensor communicating with the combustion chamber. The combustion condition sensor is configured to output a signal indicative of a combustion condition in the combustion chamber. A controller is configured to control operation of the charge former. The controller is also configured to determine a target output value of the combustion condition sensor corresponding to a target air/fuel ratio and to adjust the target output value of the combustion condition sensor as a function of at least a first engine operation characteristic.

According to yet another aspect of the invention, a method for controlling fuel injection comprises determining a target air/fuel ratio for an internal combustion engine, detecting at least a first engine operation characteristic of an internal combustion engine, determining a target output signal of the combustion condition sensor as a function of the first engine operation characteristic and adjusting operation of the fuel injector to generate an air/fuel mixture which causes the oxygen sensor to output a signal having a value approximately equal to the target output value.

Further aspects, features and advantages of the present invention will become apparent from the detailed description of the preferred embodiments which follow.

BRIEF DESCRIPTION OF THE DRAWINGS

FIG. 3 is a table illustrating values determined as a result of tests conducted on an output of a combustion condition sensor of an internal combustion engine having Throttle Position Sensor Output ($T_V$) listed in the left hand side column of the table and Engine Speeds (N) listed along the top row.

DETAILED DESCRIPTION OF THE PREFERRED EMBODIMENTS OF THE INVENTION

Figure 1:
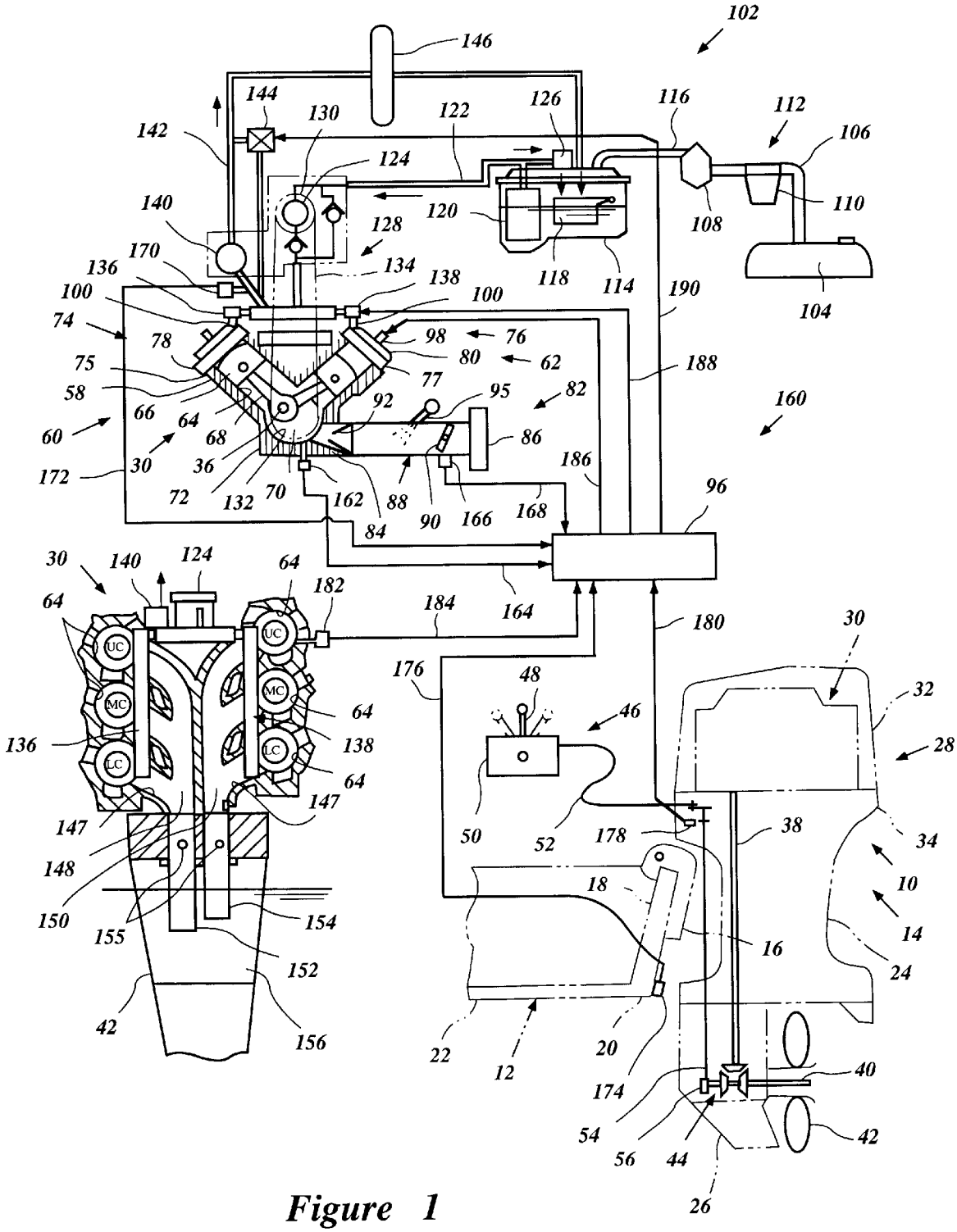
FIG. 1 is a multi-part view showing: in the lower right hand portion, an outboard motor mounted to a transom of a watercraft (show in phantom) that employs the internal combustion engine which relates to the present invention; in the upper view, a partially schematic cross-sectional view of the outboard motor with its air induction and fuel injection system shown in part schematically; in the lower left hand portion. a rear elevational view of the outboard motor with some portions removed and other portions broken away and shown in section so as to more clearly illustrate the construction of the engine; and the fuel injection system shown in part schematically. An ECU (electronic control unit) for the motor links the three views together.

With initial reference to FIG. 1, an outboard motor 10 for powering a watercraft 12 is illustrated. The outboard motor 10 advantageously has a feedback control system arranged and configured in accordance with certain features, aspects, and advantages of the present invention. The outboard motor 10 provides an exemplary environment in which the control system has a particular utility. The feedback control system of the present invention may also find utility in applications in which the engine is subjected to a broad range of engine operating states, i.e., varying engine speeds and throttle positions, for example, but without limitation, personal watercraft, small jet boards, off-road vehicles, circle track racing vehicles, and heavy construction equipment.

With reference to FIG. 1, in the illustrated embodiment, the outboard motor 10 comprises a drive unit 14 and a bracket assembly 16. Although schematically shown in FIG. 1, the bracket assembly 16 comprises a swivel bracket and a clamping bracket. The swivel bracket supports the drive unit 14 for pivotal movement about a generally vertically extending steering axis. The clamping bracket, in turn, is affixed to a transom 18 of a stern 20 of the watercraft 12, and supports the swivel bracket for pivotal movement about a generally horizontally extending axis. A hydraulic tilt system can be provided between the swivel bracket and the clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

The associated watercraft 12 is a powerboard. The watercraft 12 has a hull 22 that can define a deck. Various other components of the watercraft 12 can be disposed within the hull, for example, but without limitation, seats, a control, mast, a fuel tank, and a lubrication tank.

With reference to FIG. 1, the drive unit 14 includes a drive shaft housing 24 and a lower unit 26. A powerhead 28 is disposed atop the drive unit 14 and includes an engine 30, a top protective cowling 32, and a bottom protective cowling 34. The cowlings 32, 34 define a cowling assembly which surrounds and protects the engine 30.

The engine 30 is oriented vertically in the powerhead 28 such that its crankshaft 36 extends along a generally vertically extending axis. This orientation facilitates connection to a drive shaft 38 which is driven by the crankshaft 36.

The drive shaft 38 extends generally vertically through drive shaft housing 24. The drive shaft housing 24 also defines internal passages which form portions of the exhaust system, described in detail below.

The lower unit 26 depends from the drive shaft housing 24 and supports a propeller shaft 40. The propeller shaft 40 extends generally horizontally through the lower unit 26. In the illustrated embodiment, the propulsion device includes a propeller 42 that is affixed to an outer end of the propeller shaft 40 and is thereby driven.

A transmission 44 is provided between the drive shaft 38 and the propeller shaft 40. The transmission 44 couples the two shafts 38, 40 which lie generally normal to each other (i.e., at a 90° angle) with a bevel gear combination.

A switch mechanism 46 is provided for the transmission 44 to shift rotational directions of the propeller 42 between forward, neutral and reverse. The switch mechanism 46 includes a shift cam (not shown), a shift lever 48 mounted to a shift case 50, a shift cable 52 which is controlled by the shift lever 48, and a shift rod 54 which is controlled by the shift cable 52. The shift cable 52 extends outwardly from the lower cowling 34 to the switch lever 48 that is operable by an operator when the operator wants to shift the transmission directions. The shift rod 54 is actuated by the shift cable 52 and extends generally vertically through the drive shaft housing 24 and the lower unit 26. The shift rod 54, in turn, actuates a dog clutch 56 which controls the operation of the bevel gear combination to shift the transmission 44 between forward, neutral, and reverse.

The details of the construction of the outboard motor 10 and the components which are not illustrated may be considered to be conventional or of any type known. Those skilled in the art can readily refer to any known constructions with which to practice the invention.

With reference to FIG. 1, the engine 30 of the illustrated embodiment is a V-6 type engine and operates on a 2-stroke, crankcase compression principle. Although the invention is described in conjunction with an engine having a particular cylinder number and cylinder configuration, it will be readily apparent that the invention can be utilized with engines having other numbers of cylinders, other cylinder configurations (e.g., in-line and W-type) and operating under other combustion principles (rotary, diesel, and 4-stroke principles).

In the illustrated embodiment, the engine 30 comprises a cylinder body or cylinder block 58 that forms a pair of cylinder banks 60, 62. Each cylinder bank 60, 62 is formed with three vertically-spaced, horizontally extending cylinder bores 64 (cylinder sections are indicated as UC, MC, and LC).

Pistons 66 reciprocate in the cylinder bores 64. The pistons 66 are, in turn, connected to the upper or small ends of connecting rods 68. The big end of the connecting rods 68 are journaled on throws of the crankshaft 36 in a manner that is well known in the art.

The crankshaft 36 is journaled in a suitable manner for rotation within a crankcase chamber 70 that is formed in part by a crankcase member 72 affixed to the cylinder block 58 in a suitable manner. As is typical with 2-cycles engines, the crankshaft 36 and the crankcase chamber 70 are formed with seals so that each section of the crankshaft that is associated with one of the cylinder bores 64 will be sealed from the others. This type of construction is well known in the art.

Cylinder head assemblies, indicated generally by the reference numerals 74, 76 are affixed to the end of the cylinder banks 60, 62, respectively, opposite the crankcase chamber 70. The cylinder head assemblies 74, 76 each include a plurality of recesses (not shown) on their inner faces 75, 77. Each of these recesses cooperates with the cylinder bores 64 and the head of the pistons 66 to define combustion chambers of the engine 30. The cylinder head assemblies 74, 76 are preferably made of aluminum alloy diecast.

Cylinder head cover members 78, 80 cover the cylinder head assemblies 74, 76, respectfully. The cylinder head cover members 78, 80 are affixed to the cylinder assemblies 74, 76 and to their respective cylinder banks 60. 62 in a suitable known manner. The cylinder head cover members 78, 80 preferably are also made of aluminum alloy diecast.

With reference to the upper portion of FIG. 1, an air induction system, indicated generally by the reference numeral 82, delivers an air charge to the sections of the crankcase chamber 70 associated with each of the cylinder bores 64. The communication is via an intake port 84 formed in the crankcase member 72 and registering with each of the crankcase chamber sections.

The induction system 82 includes an air silencing and inlet device, shown schematically in the figure and indicated by the reference numeral 86. The inlet device 86 supplies the induced air to a plurality of throttle bodies 88, each of which includes a throttle valve 90 therein. These throttle valves 90 are supported on throttle valve shafts (not shown). The throttle valve shafts are linked together for simultaneous opening and closing of the throttle valves 90 in a manner that is well known in the art.

The intake ports 84 include read-type check valves 92. The check valves 92 permit the induced air to flow into the sections of the crankcase chamber 70 when the pistons 66 are moving upwardly in their respective cylinder bores 64. As the pistons 66 move downwardly, the charge will be compressed in the sections of the crankcase chamber 70. At that time, the read-type check valves 92 close to permit the charge to be compressed.

A lubricant injector 96 can be provided for spraying lubricant into the throttle bodies 88 for engine lubrication under the control of an ECU (electronic control unit), shown schematically in FIG. 1 and identified by the reference numeral 96. Although it is not shown, some forms of direct lubrication may also be employed for delivering lubricant directly to other components of the engine.

The charge which is compressed in the sections of the crankcase chamber 70 is then transferred to the combustion chambers through a scavenging system (not shown). This scavenging system preferably is of the Schnurle type and includes a pair of main scavenge passages (not shown) that are positioned on diametrically opposite sides of each cylinder bore 64. These main scavenging passages terminate in main scavenging ports (not shown) so as to direct scavenge air flows into the combustion chamber of each cylinder bore 64. Additionally, auxiliary scavenge passages are preferably formed between the main scavenge passages and terminate in auxiliary scavenging ports which provide corresponding auxiliary scavenging air flows. Thus, during the scavenging stroke of the engine 30, the intake charge is transferred to the combustion chambers for further compression. As the pistons 66 move upwardly from their bottom end or bottom dead center position, the scavenging ports are closed and the charge is further compressed.

Spark plugs 98 are affixed to the cylinder head assembly 74, 76 and extend into the combustion chambers defined in the cylinder bores 64. In the illustrated embodiment, the spark plugs 98 are disposed so as to extend along the axis of the corresponding cylinder bore 64. The spark plugs 98 are fired under the control of the ECU 96. The ECU 96 receives certain signals, as will be described, for controlling the timing of firing of the spark plugs 98 in accordance with any desired control strategy.

Each spark plug 98, in turn, ignites a fuel air charge that is formed from fuel sprayed by a fuel injector 100 and the air entering the cylinder bore 64 from the scavenge ports. In the illustrated embodiment, the fuel injectors 100 are solenoid-type and are electrically operated under the control of the ECU 96. The fuel injectors 100 are mounted directly in the cylinder head assemblies 74, 76 preferably in a location which provides optimum fuel vaporization under all running conditions.

Fuel is supplied to the fuel injectors 100 by a fuel supply system, indicated generally by the reference numeral 102 (see the upper view of FIG. 1). The fuel supply system 102 comprises a fuel tank 104 that is provided in the hull 22 of the watercraft 12. Fuel is drawn from the tank 104 through a conduit 106 preferably via a first manually-operated pump (not shown) and at least a second low pressure pump 108. The second low pressure pump 108 is a diaphragm-type pump operated by variations in pressure in the various sections of the crankcase chamber 70, and thus generates a relatively low output pressure. A quick disconnect coupling (not shown) is provided in the conduit 106. Additionally, a fuel filter 110 is provided at an appropriate location in the fuel supply line 106. The manually operated pump and the second low pressure pump 108 define a low pressure portion 110 of the fuel supply system 102.

From the second low pressure pump 108, fuel is supplied to a vapor separator 114 which is mounted on the engine 30 or within the protective cowling 32 at an appropriate location. Fuel from the second low pressure pump 108 is supplied to the vapor separator 114 via a fuel line 116. A float valve assembly 118 (schematically represented in FIG. 1) is provided for maintaining a predetermined level of fuel within the vapor separator 114.

A high pressure electric fuel pump 120 is provided within the vapor separator 114, pressurizes fuel from the vapor separator and directs the pressurized fuel into a fuel supply line 122. The fuel supply line 122 connects the high pressure electric fuel pump 120 with a high pressure fuel pump 124.

The electric fuel pump 120, which is driven by an electric motor, develops a pressure approximately between 3 and 10 $kg/cm^2$. A low pressure regulator 126 is connected to the fuel supply line 122 and limits the pressure of the fuel delivered to the high pressure fuel pump 124 by dumping fuel back to the vapor separator when the pressure in the fuel line 122 exceeds a predetermined pressure. The high pressure fuel pump 124 can develop a pressure of, for example, 50–100 kg/CM2 or more. A pump drive unit 128 is provided for driving the high pressure fuel pump 124.

As shown in FIG. 1, the high pressure fuel pump 124 is mounted rearward from the engine block 58. The high pressure fuel pump 124 and the pump drive unit 128 are mounted to the cylinder block 58 in any appropriate manner. For example, the high pressure fuel pump 124 and the drive 128 can be mounted to the engine block 58 with a stay and a plurality of bolts (not shown).

The pump drive unit 128 comprises a pulley 130 affixed to a pump drive shaft (not shown) of the high pressure fuel pump 124, a drive pulley 132 affixed to the crankshaft 36 and a flexible transmitter 134. In the illustrated embodiment, the flexible transmitter 134 can be in the form of smooth or toothed drive belt. Accordingly, the pulleys 130, 132 can have smooth or toothed outer surfaces for cooperating with the flexible transmitter 134.

The pump drive shaft is provided with a cam disk (not shown) configured to operate plungers (not shown) disposed on the side of the high pressure fuel pump 124.

An outlet of the high pressure fuel pump 124 is connected to a pair of fuel rails 136, 138 via high pressure fuel lines. The pressure of the fuel delivered to the fuel rails 136, 138 is regulated by a high pressure regulator 140 which is connected to an outlet of the high pressure fuel pump 124 or the fuel rails 136, 138. The high pressure regulator 140 returns fuel to the vapor separator 114 via a high pressure fuel return line 142. Additionally, an electromagnetic valve 144 can be connected in parallel to the high pressure regulator 140 for further control of the pressure of the fuel in the fuel rails 136, 138.

In the illustrated embodiment, a heat exchanger 146 is provided along the high pressure fuel return line 142 so as to cool the fuel returning to the vapor separator 114. The pressure in the fuel rails 136, 138, thus is maintained at a substantially uniform level during operation.

The fuel rails 136, 138 preferably are formed of metal pipes so that the fuel rails are substantially rigid. The fuel rails 136, 138 are mounted to the cylinder head assembly 74, 76, respectfully, and communicate with each of the fuel injectors 100. As noted above, during operation, fuel from the fuel injectors 100 mixes with the air delivered to the cylinder bores 64 via the scavenging ports. After the charge has been formed in the combustion chambers by the injection of fuel and air, the charge is fired by the spark plugs 98. The injection timing and duration, as well as the control of timing of the firing of the spark plugs 98, are controlled by the ECU 96.

Once the charge burns and expands, the pistons 66 are driven downwardly in the cylinder bores 64 until the pistons 66 reach the lowermost position. As the pistons 66 move downwardly, exhaust ports 147 are uncovered so as to open the cylinder bores 64 to exhaust passages formed in the cylinder block 58. The exhaust gases flow through the exhaust passages to manifold collector sections 148, 150 of respective exhaust manifolds that are formed within the cylinder block 58.

A pair of exhaust pipes 152, 154 depend from an exhaust guide plate provided in the lower cowling portion 34 and extend into an expansion chamber 156 formed in the drive shaft housing 42. The exhaust pipes 152, 154 preferably include idle ducts 155. From the expansion chamber 156, the exhaust gases are discharged to the atmosphere through a suitable exhaust system.

Preferably, the exhaust system can include an underwater, high speed exhaust gas discharge and an above water, low speed exhaust gas discharge. Since these types of systems are well known in the art, a further description of the exhaust system is not believed to be necessary to permit those skilled in the art to practice the invention.

A feedback control system, indicated generally by the reference numeral 160, controls the timing and duration of fuel injection from the fuel injectors 100 and the timing of the firing of the spark plugs 98. The feedback control system 160 comprises the ECU 96 and a number of sensors configured to output a signal indicative of various conditions including, for example, but without limitation, engine running conditions, ambient conditions or conditions of the outboard motor 10 that affect engine performance.

Certain sensors are schematically represented in FIG. 1. For example, an engine speed sensor 162 is mounted in the vicinity of the crankshaft 36 and/or flywheel attached to the crankshaft 36. The engine speed sensor 162 outputs a signal indicative of the position of the crankshaft 36 and/or the speed of rotation of the crankshaft 36. The signal from the engine speed sensor is transferred to the ECU 96 via an engine speed dataline 164.

Preferably, a crankshaft position sensor (not shown) is also mounted in the vicinity of the crankshaft 36 so as to detect the position of the crankshaft. The output signal from the crankshaft position sensor is transferred to the ECU 96 via an additional dataline (not shown). As such, the ECU 96 can receive the output signal from the crankshaft position sensor for use in determining proper fuel injection and spark plug timing, for example.

A throttle position sensor 166 can be mounted in the vicinity of the throttle valve 90 so as to detect a position of the throttle valve 90. The throttle valve position sensor 166 outputs a signal indicative of the position of the throttle valve 90. The signal from the throttle valve position sensor 166 is transferred to the ECU 96 via a throttle position data line 168. As such, the output of the throttle position sensor 166 can be used by the ECU 96 as an indication of operator demand or engine load.

For example, when an operator of the outboard motor 10 desires to accelerate the associated watercraft 12, the operator advances the throttle lever, such as the shift lever 48, thus further opening the throttle valve 90, and increasing a load on the engine. As the throttle valve position changes, the output signal of the throttle valve sensor 166 changes, thus indicating to the ECU 96 that the load on the engine has changed.

A pressure sensor 170 can be connected to the high pressure fuel return line 142 so as to detect a fuel pressure in the return line 142. The pressure sensor 170 is connected to the ECU 96 via a high pressure fuel return line data line 172. Thus, the ECU 96 can receive a signal from the high pressure fuel line sensor 170 which is indicative of the pressure in the high pressure fuel line 142.

A watercraft speed sensor 174 can be mounted to the associated watercraft 12 for detecting a speed of the watercraft. The watercraft speed sensor 174 is connected to the ECU 96 via a watercraft speed dataline 176. As such, the ECU 96 can receive a signal from the watercraft speed sensor 174 that is indicative of a speed of the associated watercraft 12.

A neutral sensor 178 can be connected to the outboard motor 10 for sensing when the forward, reverse, neutral transmission is in the neutral position. The neutral position sensor 178 is connected to ECU 96 via a neutral position sensor data line 180. As such, the ECU 96 can receive a signal from the neutral position sensor 178 that is indicative of whether the transmission is in the neutral position.

A combustion condition sensor 182 can be connected to any appropriate position on the engine 30 for detecting a combustion condition of the engine 30. The combustion condition sensor 182 is connected to the ECU 96 via a combustion condition dataline 184. As such, the ECU 96 can receive a signal from the combustion condition sensor 182 that is indicative of a combustion condition occurring during the operation of the engine 30.

In addition to the sensors described above, additional sensors may be provided for detecting other conditions such as an induction system air pressure sensor, an induction system air temperature sensor, a knock sensor, a coolant temperature sensor, an engine temperature sensor, a back pressure sensor, a trim angle sensor, a mount height sensor, an engine vibration sensor, a watercraft position sensor, an atmospheric pressure sensor, and various other sensors for use in accordance with the various control strategies.

The ECU 96, as noted above, outputs signals to the fuel injectors 100, spark plugs 98, and the electromagnetic valve 144, and/or the high pressure fuel pump 120 for their respective control. In the illustrated embodiment, the ECU 96 outputs a signal to the spark plugs 98 via a spark plug control dataline 186. The ECU 96 outputs a control signal to the fuel injectors 100 via a fuel injector control line 188. The ECU 96 outputs a control signal to the electromagnetic valve 144 via a fuel pressure control dataline 190. Additionally, the ECU 96 can be connected to various other components of the engine 30 including, for example, but without limitation, a lubrication pump, and a coolant fluid pump. As noted above, the ECU 96 can control these various components according to any known control strategy.

Additionally, as noted above, the ECU controls the air/fuel ratio of the charge combusted in the combustion chambers defined within the cylinder block 58, at least in part as a function of an output signal of the combustion condition sensor 182. In the illustrated embodiment, the combustion condition sensor 182 is in the form of an oxygen sensor. The oxygen sensor includes a sensor element that is exposed to combusted exhaust gases from the combustion chambers of the engine. Preferably, the oxygen sensor is in the form of a catalytic-type oxygen sensor. For example, the sensor element of the oxygen sensor can be formed of a ceramic material such as zirconium dioxide ($ZrO_2$) housed in a gas permeable platinum electrode.

During operation, and in particular at temperatures in excess of about 300° C., the zirconium dioxide conducts negative oxygen ions. Such a sensor is designed to be very responsive in the vicinity of Lambda (Λ) values in the vicinity of one (1), i.e., the output signal changes quickly in response to small changes in the detected air/fuel ratio in the vicinity of the ideal stochiometric air/fuel ratio. For typical gasoline powered engines, the stochiometrically ideal air/fuel ratio is about 14.7:1. As is common in the art, Lambda (Λ) is defined as equal to 1 when the air/fuel ratio is 14.7:1., Thus, typical oxygen sensors for gasoline powered internal combustion engines are configured to be very responsive when the air/fuel ratio is about 14.7:1, i.e., at Lambda (Λ) values in the vicinity of 1.

The preferred operating temperature range for such oxygen sensors is about 300° C. to 600° C. Typical oxygen sensors can be damaged, however, if exposed to temperatures above 850° C.

A first electrode of the sensor is typically exposed to a reference value of atmospheric air. Thus, a greater quantity of oxygen ions will be present on the first electrode. Through the electrolytic action, the oxygen ions permeate the electrode and migrate through the electrolyte zirconium dioxide. Thus, a charge builds in the sensor as a function of the amount of oxygen ions that are present in the vicinity of the sensor element.

When the sensor element, i.e., the second electrode, is exposed to exhaust emissions formed as a result of the combustion of a rich air/fuel mixture, there is little free oxygen in the exhaust gas. This small amount of oxygen is readily combined with carbon monoxide (CO) present in the exhaust through the catalytic action of the platinum electrode. Thus, the oxygen concentration in the exhaust gases discharged after combustion of a rich air/fuel charge is relatively low, in contrast with the oxygen content of the atmosphere. Oxygen atoms contacting the atmospheric electrode gain electrons and travel through the zirconium ceramic to the exhaust electrode where they then shed the extra electron, thus leaving a positive charge on the atmospheric electrode and a negative charge on the exhaust electrode. Through this mechanism, a small voltage of about 0.8 volts can be generated by this type of sensor.

Conversely, when the second electrode is subjected to emissions of the combustion of a lean air/fuel charge, the concentration of free oxygen in the exhaust gas is relatively large. Thus, despite the oxidizing action of the platinum electrode, there is a relatively large amount of oxygen present in the exhausts gases exposed to the sensor element. Because there are oxygen ions present at both the exhaust electrode, i.e., the sensor element, and the atmospheric electrode, little electromotive force is generated between the electrodes, thereby leaving the charge of approximately 0 volts in the sensor.

It is also conceived that other types of oxygen sensors can be employed. For example, a Universal Exhaust Gas Oxygen Sensor (UEGO sensor) can be used as the combustion condition sensor 182. A UEGO sensor, as known in the art, can measure a wide range of air/fuel ratios from very rich (10:1) to very lean (35:1). This type of sensor is more commonly used in "lean-burn" types of engines. In these types of engines, a controller is programmed to use lean mixtures during certain operating conditions, thus reducing fuel consumption.

As noted above, one aspect of the present invention includes the realization that in direct-injected engines, more air which has not been mixed with fuel, flows into the combustion chamber and contacts the oxygen sensor. Thus, oxygen sensors used with direct injected engines, erroneously perceive a higher air/fuel ratio under certain operating conditions.

Figure 2:
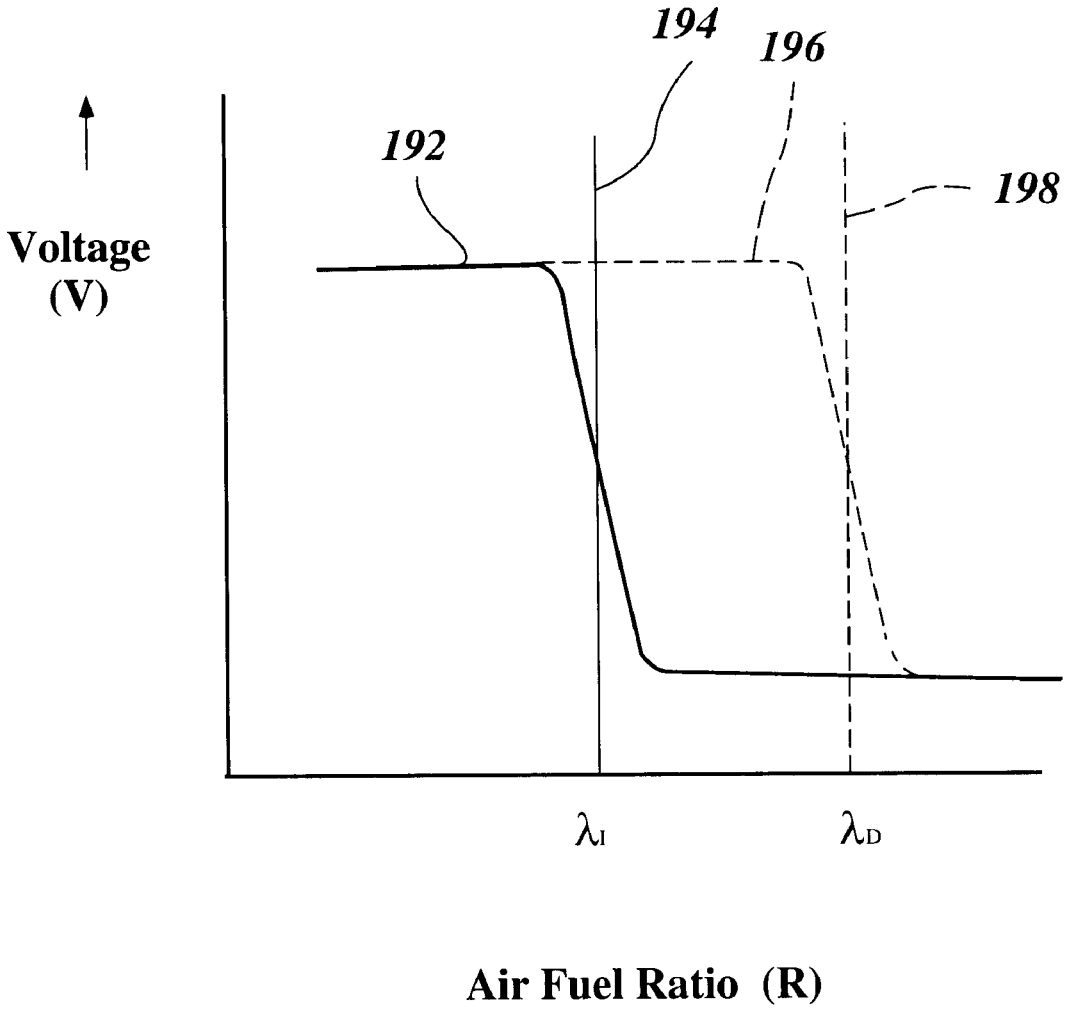
FIG. 2 is a graph having Voltage (V) plotted on the vertical axis and air/fuel ratio (A/F) plotted on the horizontal axis. One curve (shown as a solid line) plotted on the graph illustrates a voltage output response to perceived air/fuel ratio of an internal combustion engine in on operation state and a second curve (shown in phantom) illustrates a variation of the voltage output response caused by a different engine operation state.

FIG. 2 illustrates an output signal response of a typical zirconium dioxide oxygen sensor. Curve 192 illustrates an output signal of such an oxygen sensor when installed onto a direct injected two-cycle internal combustion engine. An air/fuel ratio 194 corresponds to a Lambda value ($\Lambda_I$) of 1 for the engine. As shown in FIG. 2, the output signal of the oxygen sensor changes rapidly in the vicinity of $\Lambda_I$.

In contrast, a curve 196 illustrates the output signal of an oxygen sensor for a direct injected engine under a different operating condition, for example, at a higher engine speed than that corresponding to the curve 192. As shown in FIG. 2, under a different operating condition, the voltage response of the oxygen sensor shifts towards higher Lambda values. Although the graph in FIG. 2 is exaggerated, the curve 196 has shifted, relative to the curve 192, such that the steep portion of the curve 196 is centered about an air/fuel ratio 198, corresponding to a Lambda value ($\Lambda_D$), which is higher or "leaner" than the air/fuel ratio 194. As noted above, it has been discovered that such changes in the output response of oxygen sensors causes a corresponding controller to erroneously control fuel injection of the corresponding engine.

As shown in FIG. 3, it has been found that the output signal of an oxygen sensor, such as the oxygen sensor 182, varies in accordance with changes in throttle position and engine speed, when exposed to the exhaust gases of charges having the same air/fuel ratio.

As shown in FIG. 3, a table, having a number of columns corresponding to various engine speeds and a number of rows corresponding to throttle position sensor output voltages shows that three different voltages a, b, c are output from the oxygen sensor 182 in accordance with variations of engine speed N and throttle position sensor output $T_V$. FIG. 3 illustrates that at engine speeds less than about 3500 rpm and at throttle positions less than about one-half open (corresponding to a throttle position sensor output $T_V$ between 0.5 and 1.2 volts), a value of the output signal from the oxygen sensor 182 was (a) volts. Additionally, at engine speeds greater than about 3500 rpm, for all the throttle positions, the output signal of the oxygen sensor 182 was at a voltage (b). Finally, for engine speeds of less than about 3500 rpm and throttle positions greater than about one-half, (corresponding to sensor output voltages between about 1.2 volts to about 4 volts), the output signal of the oxygen sensor 182 was at voltage (c). For the particular engine tested, the throttle position sensor output $T_V$ equal to about 1.2 volts corresponds to a position of the throttle valve 90 about one-half open. Additionally, the throttle position sensor output $T_V$ of about 4 volts corresponds to a fully open position of the throttle valve 90.

Thus, it was determined that although the air/fuel ratio in each test was the ideal value, i.e., about 14.7:1, the output voltage of the oxygen sensor 182 varied according to the engine operation characteristic of engine speed and the engine operation characteristic of the position of the throttle sensor.

Figure 4:
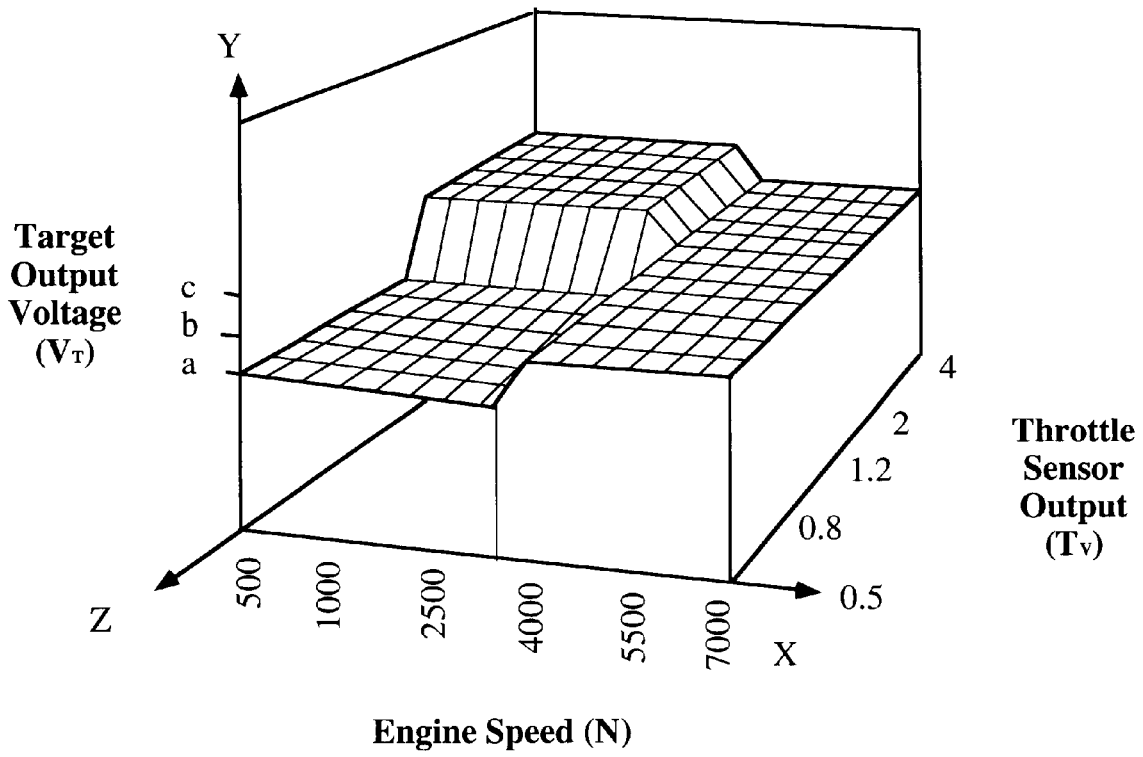
FIG. 4 is a 3-dimensional graph having Engine Speed (N) plotted on the X axis, Target Output Voltage ($V_T$) plotted on the vertical or Y axis and Throttle Valve Sensor Output Voltage ($T_V$) plotted on the Z axis. A 3-dimensional contour illustrates a relationship between the Target Output Voltage ($V_T$), Engine Speed (N) and Throttle Valve Sensor Output ($T_V$).

With reference to FIG. 4, in accordance with one aspect of the present invention, a three-dimensional map is illustrated for use by the ECU 96. As shown in FIG. 4, a target output voltage $V_T$ of the oxygen sensor 182 is plotted on the vertical axis indicated as axis Y. Throttle sensor output voltage $T_V$ is plotted along the Z axis. Additionally, engine speed (N) is plotted along the horizontal axis, indicated as axis X.

As shown in FIG. 4, the target output voltage $V_T$ varies according to engine speed and also according to throttle sensor output voltage $T_V$. The three-dimensional map illustrated in FIG. 4 can be stored in a memory (not shown) provided within the ECU 96. Thus, during operation of the engine 30, the target output voltage $V_T$ is used by the ECU 96 to control the injection duration of fuel through the fuel injectors 100.

For example, if the ECU 96 receives signals from the engine speed sensor 162 that the engine is rotating at a speed of approximately 1000 rpm and receives a signal from the throttle position sensor of about 0.8 volts, the ECU 96 accesses a memory including the three-dimensional map illustrated in FIG. 4 and determines that the appropriate target output voltage $V_T$ is (a) volts. The ECU 96 compares the output of the oxygen sensor 1 82 to the target output voltage (a) and adjusts the air/fuel ratio until the output signal from the oxygen sensor 182 is approximately the target output voltage (a).

If the ECU 96 receives a signal from the engine speed sensor 162 that the engine speed is greater than about 3500 rpm, the ECU 96 will use the target output voltage $V_T$ of (b) volts in order to control fuel injection, regardless of the output signal of the throttle position sensor 166. However, if the ECU 96 receives a signal from the engine speed sensor that the crankshaft 36 is rotating at a speed less than about 3500 rpm and receives a signal from the throttle position sensor 166 of about 1.2 volts or more, the ECU 96 will use the target output voltage $V_T$ of (c) volts. As indicated in FIG. 4, the target output voltage (a) is less than the target output voltage (b), which is less than the target output voltage (c).

It is to be noted that the feedback control system 160 can be in the form of a hard wire feedback control circuit, as schematically represented in FIG. 1. Alternatively, the feedback control system 160 can be constructed of a dedicated processor and a memory for storing a computer program configured to perform the control described above. Additionally, the feedback control system 160 may be constructed of a general purpose computer having a general purpose processor and a memory for storing the computer program for performing the control described above. Preferably, however, the feedback control system 160 is incorporated into the ECU 96 in any of the above-mentioned forms.

As noted above, by constructing the outboard motor 30 as described above, the present invention provides for enhanced control of the air/fuel ratio of the air/fuel charges combusted in the combustion chambers of the engine 30. Thus, better emissions control is possible.

Of course, the foregoing description is that of certain features, aspects and advantages of the present invention to which various changes and modifications may be made without departing from the spirit and scope of the present invention. Moreover, an outboard motor may not feature all objects and advantages discussed above to use certain features, aspects and advantages of the present invention. Thus, for example, those skilled in the art will recognize that the invention may be embodied or carried out in a manner that achieves or optimizes one advantage or a group of advantages as taught herein without necessarily achieving other objects or advantages as may be taught or suggested herein. The present invention, therefore, should only be defined by the appended claims.

What is claimed is:

1. An internal combustion engine having an engine body defining at least one combustion chamber, a throttle valve affecting a flow of air into the at least one combustion chamber, a charge former configured to deliver fuel to the engine body to form an air/fuel mixture within the combustion chamber for combustion therein, a combustion condition sensor communicating with the combustion chamber, the combustion condition sensor configured to output a signal indicative of a combustion condition in the combustion chamber, and a controller communicating with the combustion condition sensor and configured to control operation of the charge former, the controller including a memory having a three-dimensional map stored therein, the three-dimensional map including data regarding a target output value of the combustion condition sensor as a function of a first and a second engine operation condition, the controller being configured to adjust an air fuel ratio of the fuel and air delivered to the engine such that a value of the output signal of the combustion condition sensor is approximately the target output value, wherein a first engine operation state comprises engine speeds less than about 3500 rpm and throttle valve positions between approximately closed and about one-half open.

2. The engine according to claim 1, wherein a second operation state comprises engine speeds between about 3500 rpm and a maximum rated speed of the engine, and all throttle valve positions.

3. The engine according to claim 2 additionally comprising a third operation state of the engine defined by the three-dimensional map, the third operation state comprising engine speeds up to about 3500 rpm and throttle valve positions from about one-half open to about fully open.

4. The engine according to claim 3, wherein a first target output value corresponds to the first engine operation state, and a second target output value corresponds to the second operation state, the second target output value being greater than the first target output value.

5. The engine according to claim 4, wherein the three-dimensional map defines a third target output value corresponding to the third engine operation state, the third target output value being larger than the first and second target output value.

6. An internal combustion engine having an engine body defining at least one combustion chamber, a charge former configured to deliver fuel to the engine body to form an air/fuel mixture within the combustion chamber for combustion therein, a combustion condition sensor communicating with the combustion chamber, the combustion condition sensor configured to output a signal indicative of a combustion condition in the combustion chamber, and a controller communicating with the combustion condition sensor and configured to control operation of the charge former, the controller being configured to determine a target output value of the combustion condition sensor corresponding to a target air/fuel ratio and to adjust the target output value as a function of at least a first engine operation characteristic, wherein the controller is configured to define a first target output value as corresponding to engine speeds less than about 3500 rpm and a second target output value as corresponding to engine speeds greater than about 3500 rpm, the second target output value being greater than the first target output value.

7. An internal combustion engine having an engine body defining at least one combustion chamber, a charge former configured to deliver fuel to the engine body to form an air/fuel mixture within the combustion chamber for combustion therein, a combustion condition sensor communicating with the combustion chamber, the combustion condition sensor configured to output a signal indicative of a combustion condition in the combustion chamber, and a controller communicating with the combustion condition sensor and configured to control operation of the charge former, the controller being configured to determine a target output value of the combustion condition sensor corresponding to a target air/fuel ratio and to adjust the target output value as a function of at least a first engine operation characteristic, additionally comprising a throttle valve affecting a flow of air into the combustion chamber, wherein the first engine operation characteristic is position of the throttle valve, wherein the controller is configured to define a first target output value as corresponding to throttle valve positions less than about one-half open, and a second target output value as corresponding to throttle valve positions greater than about one-half open, the second target output value being greater than the first target output value.

8. An internal combustion engine having an engine body defining at least one combustion chamber, a charge former configured to deliver fuel to the engine body to form an air/fuel mixture within the combustion chamber for combustion therein, a combustion condition sensor communicating with the combustion chamber, the combustion condition sensor configured to output a signal indicative of a combustion condition in the combustion chamber, and a controller communicating with the combustion condition sensor and configured to control operation of the charge former, the controller being configured to determine a target output value of the combustion condition sensor corresponding to a target air/fuel ratio and to adjust the target output value as a function of at least a first engine if Ad operation characteristic, wherein the controller is configured to vary the target output value of the combustion condition sensor in accordance with a second engine operation characteristic, additionally comprising a throttle valve affecting a flow of air into the combustion chamber, wherein the first engine operation characteristic is engine speed and the second engine operation characteristic is a position of the throttle valve, wherein the controller is configured to define a first target output value as corresponding to engine speeds below about 3500 rpm and throttle valve positions below about one-half, a second target output value as corresponding to engine speeds above about 3500 rpm and a third target output value as corresponding to throttle valve positions greater than about one half open and engine speeds less than about 3500 rpm.

9. The engine according to claim 8, wherein the first target output value is less than the second target output value, and the second target output value is less than the third target output value.

* * * * *